United States Patent [19]

Poehlmann

[11] Patent Number: 4,765,206

[45] Date of Patent: Aug. 23, 1988

[54] CORKSCREW

[76] Inventor: Paul W. Poehlmann, 6480 Panoramic Hwy., Stinson Beach, Calif. 94970

[21] Appl. No.: 58,151

[22] Filed: Jun. 4, 1987

[51] Int. Cl.[4] ..... B67B 7/04

[52] U.S. Cl. ..... 81/3.37; 81/3.29

[58] Field of Search ..... 81/3.29, 3.33, 3.36, 81/3.37, 3.4, 3.41, 3.42; 254/18, 108; 269/68, 212

[56] References Cited

U.S. PATENT DOCUMENTS 593,698 11/1897 Stoll ..... 81/3.37

683,004 9/1901 Schermack ..... 81/3.33

*Primary Examiner*—Debra Meislin

*Attorney, Agent, or Firm*—Lothrop & West

[57] ABSTRACT

A cork extractor for a cork in a bottle has a frame adapted to engage the bottle end around the axis of the cork and has a rod slidable and rotatable in the frame in line with the cork. A lever pivoted on the frame has a yielding pawl adapted individually to engage and successively to ride over each one of a series of stops on the rod, in this way incrementally extracting the cork with each actuation of the lever.

10 Claims, 1 Drawing Sheet

CORKSCREW

BRIEF SUMMARY OF THE INVENTION

A cork extractor has a frame engageable with the end of a bottle neck around the axis of a cork therein. A rod slidable and rotatable in the frame has a screw threadable into the cork and has a number of spaced stops individually and successively engageable by a yieldable pawl at the end of a lever pivoted on the frame, whereby repeated operation of the lever extracts the cork in increments.

DETAILED DESCRIPTION

Figure 1:
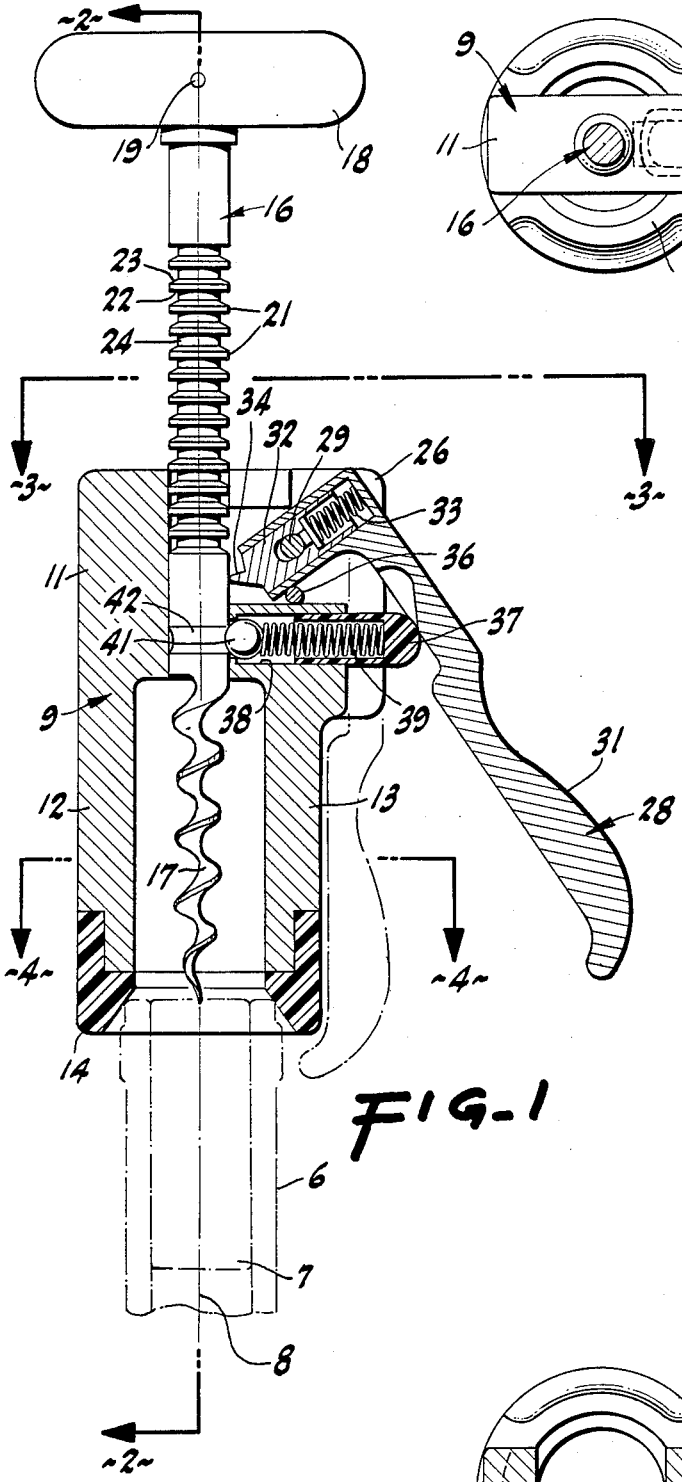
FIG. 1 is a side elevation with portions in axial section of a corkscrew of the invention.
Figure 3:
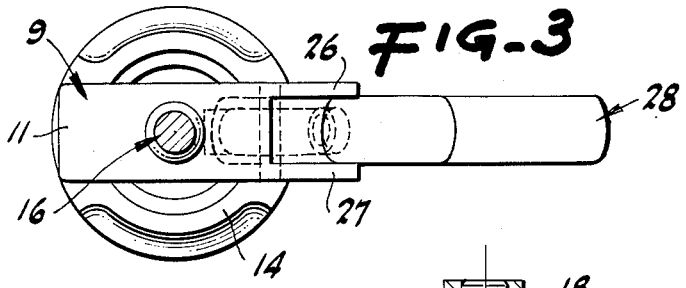
FIG. 3 is a cross-section, the plane of which is indicated by the line 3—3 of FIG. 1.

While the corkscrew or cork extractor of the invention can be embodied in a variety of different ways and is adaptable for use under sundry different circumstances, it has with success been employed as shown herein. In this instance a customary use is with a bottle neck 6 of cylindrical character, as usual, and having a generally circular-cylindrical, somewhat yieldable cork 7 inserted therein so that the end of the cork is substantially flush with the end of the bottle neck.

For use in extracting such a cork along the axis 8 thereof there is provided a frame 9 preferably of metal or stiff plastic having a framework 11 including a pair of legs 12 and 13 in turn carrying a circular abutting ring 14. This is conveniently of a softer material such as a yielding plastic in order to seat well and without high local pressure against the bottle neck end.

Mounted coaxially to slide along the axis 8 in the frame 11 is a rod 16 at one end formed as a cork-engaging screw 17 and at the other end carrying a manual crosswise bar 18 secured in place by a pin 19. Between the ends, the rod 16 is especially formed with a number of circumferentially disposed stop rings 21. Each stop ring has a generally planar bottom portion 22 and a conical top portion 23, the successive stop rings being separated by intervening grooves 24.

Pivotally mounted on the frame 11 between frame wings 26 and 27 is a lever 28 engaging a cross pin 29 and having a palmabutment configuration 31. One end of the L-shaped lever 28 is hollow and carries a pawl member 32, of a generally cylindrical nature, having a slotted engagement with the pin 29. A spring 33 is interposed between a portion of the lever and the pawl end 32 to urge the pawl toward the axis 8. The end of the pawl member 34 is particularly configured in one position to nest well in any one of the grooves 24 beneath the stop ring bottom portion 22 or to ride over the cone 23. There is a stop pin 36 limiting the movement of the lever 28 in one direction.

To control the movement of the lever 28 in the other direction, there is afforded a plunger 37 slidable in a bore 38 in the framework against a return spring 39. This abuts against a detent ball 41 urged against a flange in the frame. The ball 41 projects just far enough to engage lightly in a circumferential positioning groove 42 or detent groove in the stem 16 between the screw 17 and the series of stop rings 21.

In the customary condition of the structure, the parts rest substantially as shown in FIG. 1. For occasional or incidental use, the user by holding the frame 9 and pulling on the bar 18 can axially withdraw the screw mechanism entirely from the frame. He can then use the corkscrew, separately, in the conventional way by introducing the screw into the bottle cork. Then, by holding the bottle by hand or between his knees while pulling on the bar 18, he can extract the cork.

The intended use of the corkscrew, however, is not in that fashion. Rather, it is by first placing the assembled structure so that the relatively soft, plastic collar 14 is against the neck of the bottle and then, with the parts as shown in FIG. 1, turning the bar 18 in a clockwise direction so as to drive the screw portion 17 of the rod 16 well into the cork for substantially the entire length thereof while the ring 14 is still in contact with the bottle neck rim.

Having engaged a full length of the screw with the cork, the user then places his palm against the portion 31 of the lever 28 and curls his fingers of the same hand around or against the opposite leg 12 of the frame. He then squeezes his hand together and so moves the lever in a clockwise direction (in FIG. 1) about the pivot 29. The pawl 34, also moving clockwise, lifts sufficiently to engage with the lower part of an adjacent one of the stop rings 21, the pawl end 34 lodging beneath the stop ring. The user relaxes his hand and by further squeezing movement causes the lever to act further as a jack to lift the rod and so lift the engaged cork an additional way out of the bottle neck. Again the user relaxes his grip, permitting the spring 33 to restore the parts to positions as shown in FIG. 1. This permits the pawl 34 freely to ride over the adjacent stop ring 21 and to engage under the successive one of the stop rings. The lever 28 is again grasped and so moved toward the frame 9. The pawl 34 engages under the next successive stop ring and lifts the stem another increment and simultaneously lifts the cork a comparable amount. After several squeezing and relaxing motions by the user on the lever, the cork is entirely lifted from the bottle. The cork, with the entire corkscrew, can then be taken away from the bottle by grasping the bar 18 in the customary way.

Figure 2:
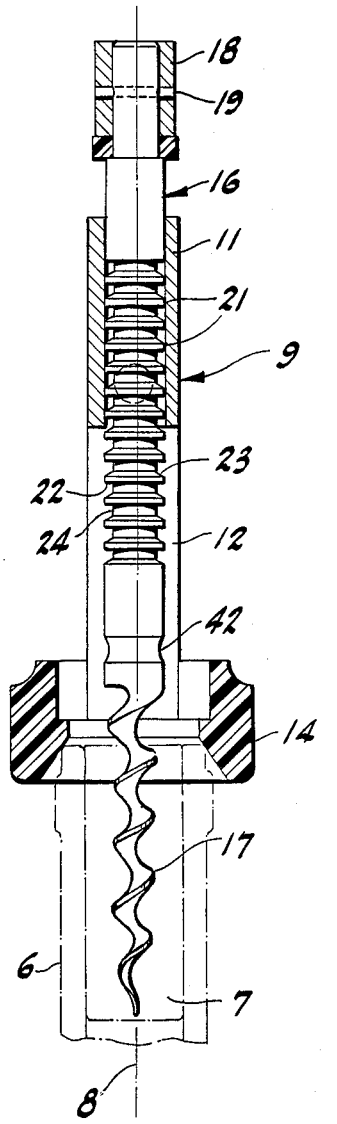
FIG. 2 is a cross-section, the plane of which is indicated by the line 2—2 of FIG. 1.
Figure 4:
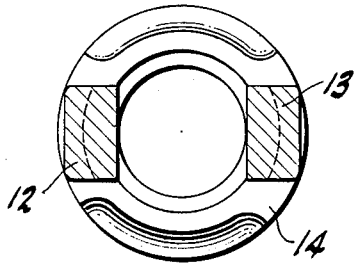
FIG. 4 is a cross-section, the plane of which is indicated by the line 4—4 of FIG. 1.

The extracted cork, which is easily graspable by the user's fingers since it projects slightly from the sides of the framework between the members 12 and 13, can be rotated relatively to the corkscrew and removed for any desired purpose. The parts can be returned to the position shown in FIG. 2 and the corkscrew is then ready for another cork extraction process.

The squeezing motion utilized is advantageous in that the corkscrew can be used to extract a cork from a bottle while the bottle is sitting upright on a table, for example, and without any particular extra lateral or axial restraint on the bottle itself. The principal force is employed largely within or through the corkscrew itself, thus simplifying the maneuvers necessary to withdraw the cork from the bottle.

I claim:

1. A cork extractor for use with a corked bottle comprising a frame having a first axis, a collar at one end of said frame adapted to abut the end of said bottle in the vicinity of the cork therein, a rod rotatably engaging said frame and slidable therein along said axis, a cork engaging means at one end of said rod means defining a plurality of axially spaced stop rings on said rod, a lever, means for pivoting said lever on said frame to swing about a second axis spaced from and normal to said first axis, a pawl, means for mounting said pawl to telescope in said lever along a third axis substantially intersecting said first axis, a spring for urging said pawl toward said rod, and surface means on said rod for engagement with a surface means on said pawl for moving said rod and pawl together in one direction of lever motion and for ratcheting said pawl allowing relative movement between said rod and pawl in the other direction of lever motion.

2. A device as in claim 1 in which said plurality of stop rings and disposed between a plurality of circumferential grooves in said rod, each of said grooves being defined on one side by a substantially planar surface and defined on the other side by a substantially conical surface forming said surface means of said rod.

3. A device as in claim 2 in which each of said planar surfaces is substantially normal to said first axis and each of said conical surfaces is substantially concentric with said first axis.

4. A device as in claim 2 in which said surface means of comprises a substantially planar surface adapted to engage said planar surface of each of said grooves and has a substantially angled surface adapted to engage said substantially conical surface of each of said grooves.

5. A device as in claim 2 in which said plurality of said circumferential grooves are disposed axially adjacent each other along said rod.

6. A device as in claim 1 including a second spring interposed between and exerting force on said lever and said frame for urging said lever in one direction relative to said frame.

7. A device as in claim 1 including a yieldable detent interposed between and exerting force upon said rod and said frame for inhibiting sliding movement of said rod in said frame.

8. A device as in claim 7 in which said detent includes a depression in said rod and includes a ball in said frame urged by a spring interposed between said ball and said frame for urging said ball toward said depresssion.

9. A device as in claim 1 wherein said cork engaging means includes a cork engaging screw extending coaxially from one end of said rod, rotatable and axially movable in unison therewith, and of a diameter no larger than the diameter of said rod to be removable from said frame in unison with said rod.

10. A device as in claim 9 in which said rod and said screw are substantially integral, means defining a detent groove around said rod, and a detent mounted on said frame and yieldably movable into said groove.

* * * * *